US006353977B1

(12) United States Patent
Hagmann

(10) Patent No.: US 6,353,977 B1
(45) Date of Patent: Mar. 12, 2002

(54) UNFOLDING BRACELET CLASP

(75) Inventor: Jean-Pierre Hagmann, Genève (CH)

(73) Assignee: Montres Rolex S.A.

( * ) Notice: Subject to any disclaimer, the term of this patent is extended or adjusted under 35 U.S.C. 154(b) by 0 days.

(21) Appl. No.: 09/381,787

(22) PCT Filed: Sep. 17, 1997

(86) PCT No.: PCT/CH97/00348

§ 371 Date: Sep. 22, 1999

§ 102(e) Date: Sep. 22, 1999

(87) PCT Pub. No.: WO99/13747

PCT Pub. Date: Mar. 25, 1999

(51) Int. Cl.[7] ..... A44C 5/24
(52) U.S. Cl. ..... 24/71 J; 24/265 WS
(58) Field of Search ..... 24/265 WS, 71 J, 24/685, 70 J, 70 R, 69 ST, 69 J, 71 R, 74 ST, 68 E, 179, 180

(56) References Cited

U.S. PATENT DOCUMENTS 1,243,291 A * 10/1917 Hazelton
1,778,313 A * 10/1930 Darling
1,821,329 A * 9/1931 Spinnler
1,861,029 A * 5/1932 Sand
1,861,700 A 6/1932 Johnson
4,424,611 A * 1/1984 Mori
5,485,659 A * 1/1996 Kashikie et al.

FOREIGN PATENT DOCUMENTS

GB 347968 5/1931
GB 2158145 11/1985

* cited by examiner

*Primary Examiner*—James R. Brittain
(74) *Attorney, Agent, or Firm*—Horst M. Kasper

(57) ABSTRACT

The invention concerns an unfolding bracelet clasp, in particular a watch bracelet, formed of two strands (A) and (B), comprising a metal plate (10) whereof one end is coupled with an articulation (11) at the bracelet strand (A) free end and a lever (12) whereof the pin (13) is mounted at the plate (10)other end. Said lever (12) comprises a U-shaped part whereof the legs extend on each side of the bracelet forming at their ends hooks (18) designed to be urged in engagement, when the bracelet is closed, with the ends of a spring box axle (20) transversely housed in the bracelet strand (A) at some distance from the articulation (11)substantially equal to the plate (10) length. The length of the bracelet is adjusted by a dog point (19) engaged in a suitable hole of the bracelet strand (B).

15 Claims, 1 Drawing Sheet

UNFOLDING BRACELET CLASP

It is an object of the present invention to furnish an unfolding bracelet clasp, in particular for a watch bracelet.

The clasps of this type include a rigid or flexible plate, wherein the ends of the plate are articulated in the neighborhoods of the ends of two strands of the bracelet and include means which allows these latter strands to be joined when the clasp is folded.

The advantage of these clasps relative to those including two plates articulated amongst each other is based on the fact that they are not in contact with the skin, which contact is susceptible to cause skin irritations, feelings of cold, and the like.

Nevertheless unfolding clasps with one plate which are known furnish, when they are closed, an important inconvenience inherent in the means intended to maintain the two strands fixed one to the other, namely the inconvenience of opening at the wrong moment by a certain pulling, for example accidental pulling, exerted on the two strands of the bracelet.

This inconvenience does not exist in the clasp according to the present invention, defined by the claim 1, because a pulling exercised on the two strands of the bracelet has the effect of reinforcing the locking between there ends and thus to convey to the clasp a maximum closing safety.

The drawing attached hereto represents, schematically and by way of example, an embodiment of the object of the invention.

The clasp shown is mounted on a watch bracelet formed by two strands A and B.

The clasp comprises a metal plate 10, showing a longitudinal opening 10', wherein one end of the metallic plate 10 is hinged by a joint 11 to the free end of the strand A of the bracelet and to a lever 12, wherein the axis 13 of the lever 12 is mounted to the other end of the plate 10.

Figure 1:
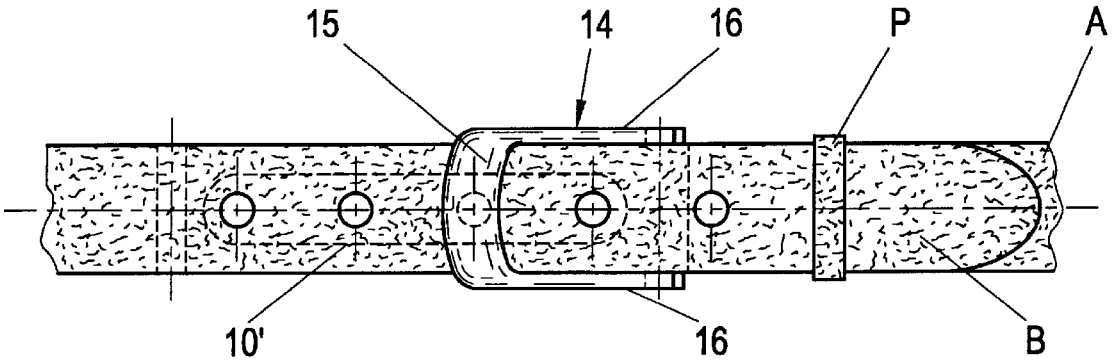
FIG. 1 is a top planar view, in the closed position.
Figure 2:
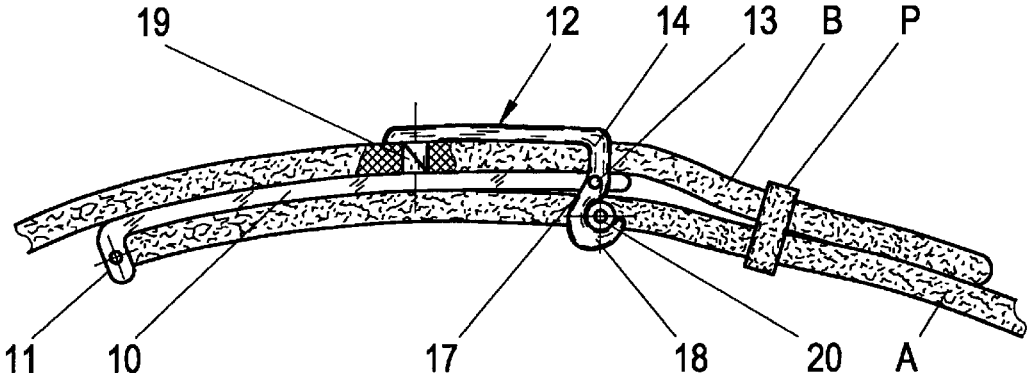
FIG. 2 is a side elevational view of the embodiment of FIG. 1.
Figure 3:
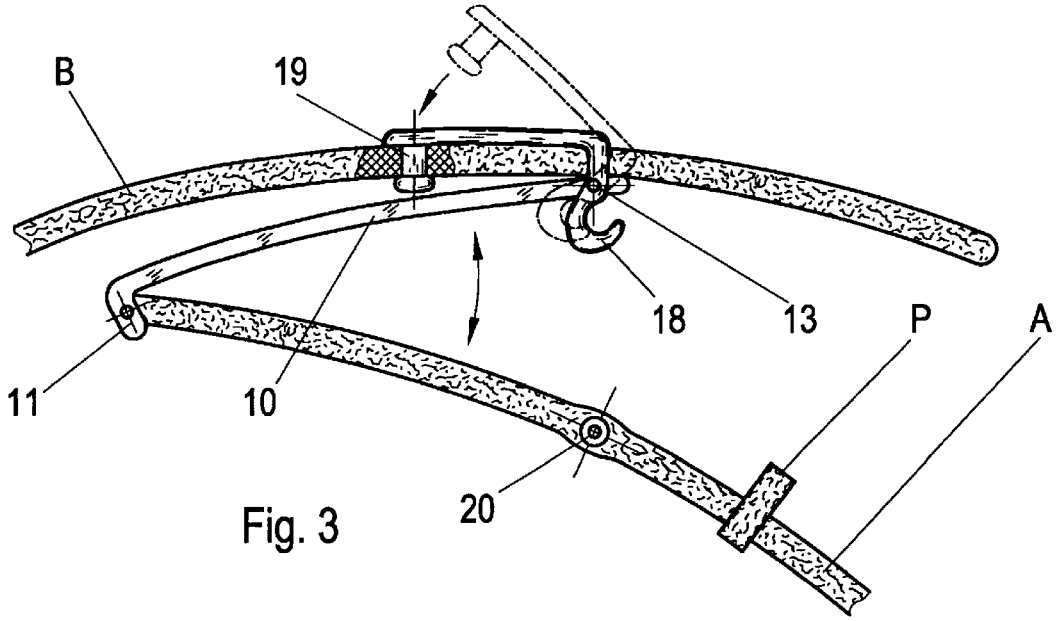
FIG. 3 is the view analogous to that of FIG. 2 showing the clasp opened and partially unfolded.

This lever 12 comprises a bent piece, formed like a U, where the size of the bent piece corresponds to that of the bracelet. The arm 14 of the bent piece is formed by the base 15 and a pair of two legs 16 of the this piece. The arm 17 of the bent piece is formed at the ends in the shape of hooks 18 of these legs 16. The base 15 includes a locking stud 19 in the shape of a mushroom (FIGS. 2 and 3). The clasp comprises further a spring box axle 20 transversely attached to the strand A of the bracelet at an articulation distance 11 substantially equal to the length of the plate 10. The ends of the spring box axles exceed laterally the bracelet and have a diameter equal to the inner diameter of the hook 18.

The axle 13 and the arm 14 form a buckle which traverses the end of the strand B of the bracelet. The setting of the length of the bracelet is effected by entering the locking stud 19 into an appropriate hole of the strand B of the bracelet through pressing (FIG. 3). During this operation the head of the locking stud 19 moves elastically the walls of the hole apart and springingly, from the side of the plate 10, into a space defined by the opening 10'. The lever 12 is this way joined to the strand B.

One holds back the assembly formed by the plate 10 and by the free end of the strand B of the bracelet on the strand A of the bracelet for closing the bracelet set in its length by exercising during the time of this motion a pressure with the thumb onto the base 15 in the kind of lightly deforming the strand A and to allow that the hooks 18 engage at the ends of the spring box axle 20. Simultaneously, the free end of the strand is introduced in the strap P.

With the pressure on the base 15 ending, the strand A reassumes its natural form and the hooks 18 remain engaged with the spring box axle 20 thereby ensuring the closure of the bracelet (FIG. 2).

In order to open the bracelet, one exits the free end of the strand B from the strap P, then one raises the free end of the strand B which causes the disengagement of the hooks 18 from the spring box axle 20 and allows the unfolding of the clasp.

The invention is obviously not limited by the embodiment represented and described above.

In particular, the closing of the clasp could be obtained by other means than the hooks 18. One could for example give to the free ends of the legs 16 a form such that they could be engaged and maintained in the strap P by preventing the two strands A and B from moving apart one from the other.

According to another variation one could replace the hooks 18 by a tongue.

What is claimed is:

1. Unfolding bracelet clasp for a watch bracelet, comprising a set plate (10), wherein the ends of the plate are connected by hinges to the ends of a lower strand (A) and of an upper strand (B); and a lever (12), wherein an axle (13) of the lever (12) forms one of said hinges, wherein one arm (14) offers means (19) allowing to hold the set plate (10) in a folded up position on the upper strand (B), and wherein another arm (17) offers means (18) allowing to fasten said plate (10), thus folded up, to the lower strand (A);

wherein the said means allowing to fasten said plate (10) include at least one hook co-operating with an element (20) of the lower strand (A); wherein the said element (20) is a spring box axle mounted transversely in the lower strand (A).

2. The clasp according to claim 1, wherein the said lever (12) is formed by a bent piece of U shape, wherein a base (15) and a part of legs (16) form said one arm (14), wherein this piece forms a buckle with an axle (13).

3. The clasp according to claim 1, wherein the said means (18) allowing to fasten said plate (10) are arranged in a way to cooperate with a strap of the bracelet.

4. The clasp according to claim 1, wherein the said means (18) allowing to fasten said plate (10) are arranged in a way to cooperate with a strap of the bracelet.

5. Unfolding bracelet clasp for a watch bracelet, comprising a set plate (10), wherein the ends of the plate are connected by hinges to the ends of a lower strand (A) and of an upper strand (B); and a lever (12), wherein an axle (13) of the lever (12) forms one of said hinges, wherein one arm (14) offers means (19) allowing to hold the set plate (10) in a folded up position on the upper strand (B), and wherein another arm (17) offers means (18) allowing to fasten said plate (10), thus folded up, to the lower strand (A);

wherein the said means allowing to fasten said plate (10) include at least one hook co-operating with an element (20) of the lower strand (A); wherein the said lever (12) is formed by a bent piece of U shape, wherein a base (15) and a part of legs (16) form said one arm (14), wherein this piece forms a buckle with an axle (13); wherein said arm (17) is formed at its ends in the shape of hooks (18) of legs of the piece of U shape.

6. The clasp according to claim 5, wherein the said element (20) is a spring box axle mounted transversely in the lower strand (A).

7. Unfolding bracelet clasp for a watch bracelet, comprising a set plate (10), wherein the ends of the plate are connected by hinges to the ends of a lower strand (A) and of an upper strand (B); and a lever (12), wherein an axle (13) of the lever (12) forms one of said hinges, wherein one arm (14) offers means (19) allowing to hold the set plate (10) in a folded up position on the upper strand (B), and wherein another arm (17) offers means (18) allowing to fasten said plate (10), thus folded up, to the lower strand (A);

wherein the said means allowing to fasten said plate (10) include at least one hook co-operating with an element (20) of the lower strand (A); wherein the said lever (12) is formed by a bent piece of U shape, wherein a base (15) and a part of legs (16) form said one arm (14), wherein this piece forms a buckle with an axle (13);

wherein the said means (19) allowing to hold the set plate (10) are formed by a locking stud which extends from the base (15) and which is susceptible to engage under pressure in one of several of holes of the bracelet.

8. Unfolding bracelet clasp, in combination, comprising one rigid or elastic plate (10) wherein the ends of this plate (10) are respectively connected by hinges (11,13) to the ends of two strands (A,B) of a bracelet, and a lever (12), wherein an axle (13) forms a hinge (13), wherein a first arm (14) offers first means (19) allowing to hold the said plate (10) in folded up position on the upper strand (B), and wherein a second arm (17) offers second means (18) allowing to fasten said plate (10) thus folded up, to the lower strand (A);

wherein the said second means (18) include at least one hook (18) co-operating with, an element (20) of the lower strand (A);

wherein the said element (20) is a small bar (20) mounted transversely in the lower strand (A).

9. The clasp according to claim 8, wherein the said lever (12) is formed by a bent piece (12) of U shape, wherein a base (15) and a part of legs (16) form the said first arm (14), wherein this piece forms a buckle with said axle (13).

10. Unfolding bracelet clasp, in combination, comprising one rigid or elastic plate (10) wherein the ends of this plate (10) are respectively connected by hinges (11,13) to the ends of two strands (A,B) of a bracelet, and a lever (12), wherein an axle (13) forms a hinge (13), wherein a first arm (14) offers first means (19) allowing to hold the said plate (10) in folded up position on the upper strand (B), and wherein a second arm (17) offers second means (18) allowing to fasten said plate (10) thus folded up, to the lower strand (A);

wherein the said second means (18) include at least one hook (18) co-operating with, an element (20) of the lower strand (A);

wherein the said lever (12) is formed by a bent piece (12) of U shape, wherein a base (15) and a part of legs (16) form the said first arm (14), wherein this piece forms a buckle with said axle (13);

wherein said second arm (17) is formed at its ends in the shape of hooks (18) of legs (16) of the piece (12) of U shape.

11. The clasp according to claim 10, wherein the said element (20) is a small bar (20) mounted transversely in the lower strand (A).

12. Unfolding bracelet clasp, in combination, comprising one rigid or elastic plate (10) wherein the ends of this plate (10) are respectively connected by hinges (11,13) to the ends of two strands (A,B) of a bracelet, and a lever (12), wherein an axle (13) forms a hinge (13), wherein a first arm (14) offers first means (19) allowing to hold the said plate (10) in folded up position on the upper strand (B), and wherein a second arm (17) offers second means (18) allowing to fasten said plate (10) thus folded up, to the lower strand (A);

wherein the said second means (18) include at least one hook (18) co-operating with, an element (20) of the lower strand (A);

wherein the said lever (12) is formed by a bent piece (12) of U shape, wherein a base (15) and a part of legs (16) form the said first arm (14), wherein this piece forms a buckle with said axle (13);

wherein the said second means (19) are formed by a locking stud (19), which extends from the said base (15) and which is susceptible to engage under pressure in one of several of holes of a strand (B).

13. The clasp according to claim 12, wherein the said element (20) is a small bar (20) mounted transversely in the lower strand (A).

14. An unfolding bracelet clasp for a watch bracelet in combination comprising a lower strand (A);

an upper strand (B);

an axle (13) forming a hinge (13);

a hinge (11);

a single set plate (10) only, wherein ends of this single set plate (10) are respectively connected by the hinges (11,13) to ends of the lower strand (A) and of the upper strand (B);

one arm (14) offering means (19) allowing to hold the said set plate (10) in a folded up position on the upper strand (B);

a lever (12) connected to the arm (14), wherein the said lever (12) is formed by a bent piece (12) of U shape;

a second arm (17) offering means (18) allowing to fasten said set plate (10), thus folded up, to the lower strand (A);

wherein said second arm (17) is formed at its ends in the shape of hooks (18) of legs (16) of the piece (12) of U shape.

15. An unfolding bracelet clasp for a watch bracelet in combination comprising a lower strand (A);

an upper strand (B);

an axle (13) forming a hinge (13);

a hinge (11);

a single set plate (10) only, wherein a first end of this single set plate (10) is connected by the hinge (11) directly to an end of the lower strand (A) and wherein a second end of this single set plate (10) is connected by the hinge (13) to the upper strand (B); one arm (14) offering second means (19) allowing to hold the said set plate (10) in a folded up position on the upper strand (B), wherein a base (15) and a part of legs (16) form the said first arm (14);

a lever (12) connected to the arm (14);

a second arm (17) offering first means (18) allowing to fasten said set plate (10), thus folded up, to the lower strand (A);

wherein the said second means (19) are formed by a locking stud (19), which extends from the said base (15) and which is susceptible to engage under pressure in one of several of holes of a strand (B).

* * * * *